US005307712A

United States Patent [19]

Pratt

[11] Patent Number: 5,307,712

[45] Date of Patent: May 3, 1994

[54] TOOL FOR INSTALLING AND REMOVING FILTERS

[76] Inventor: Jerry D. Pratt, 9333 Loma Vista Dr., Dallas, Tex. 75243

[21] Appl. No.: 12,577

[22] Filed: Feb. 3, 1993

[51] Int. Cl.[5] ..... B25B 13/52

[52] U.S. Cl. ..... 81/64; 81/3.43; 81/120

[58] Field of Search ..... 81/3.4, 3.43, 64, 65, 81/120

[56] References Cited

U.S. PATENT DOCUMENTS

| | | | |
|---|---|---|---|
| 2,959,994 | 11/1960 | Kile | 81/3.4 X |
| 4,896,570 | 1/1990 | Bourgeois | 81/64 |
| 4,945,791 | 8/1990 | Herschler et al. | 81/3.4 X |

*Primary Examiner*—James G. Smith

*Attorney, Agent, or Firm*—David L. McCombs

[57] ABSTRACT

An oil filter canister gripping tool (9) is hereby disclosed to assist in the removal and installation of an oil filter (10) on an automobile engine or similar engine and is composed of a relatively flexible strip of U-shaped material (1) having a metal band (2) attached perpendicularly thereto and located near the open ends of the arms of the U-shaped material (1) with said metal band (2) having an adjusting mechanism (4) associated therewith for tightening the band (2) securely around various size oil filter canisters (10). The U-shaped metal strip (2) having a hand-grasping area (8) located between the two arms of the U-shaped metal strip (1) enabling an individual to physically grip said hand grasping area (8) of the wrench (9) and thus permitting the rotational installation and removal of an oil filter canister (10) by means of wrist action.

3 Claims, 1 Drawing Sheet

TOOL FOR INSTALLING AND REMOVING FILTERS

TECHNICAL FIELD

The present invention relates in general to a tool that attaches to an oil filter canister and in particular a wrench that can be adjusted to grip various size oil filter canisters to assist in changing oil filters on an automobile engine o similar engine.

BACKGROUND ART

It is common knowledge that most oil filters of the canister type can not be removed by hand alone. This condition is due to the tightness required to seal an oil filter to the engine block in order to prevent oil leakage under pressure. Also in cases where the automobile has recently been driven the engine oil will heat the oil filter canister to the point that an individual may suffer sever burns in grasping the oil filter canister by hand.

As can be seen by reference to the following U.S. Pat. Nos. 4,552,040; 4,266,452; 4,643,053; 3,385,141; 4,964,330; 5,065,648; and 5,090,274; the prior art is replete with myriad and diverse oil filter wrenches and devices designed to assist in the removal or installation of oil filters.

Most oil filter wrenches that can be adjusted to fit various size oil filter canisters require a large area in which to extend the handle in order to obtain the necessary leverage to tighten the device around the oil filter canister. Likewise, the handle must remain extended to apply the torque required to tighten or loosen the oil filter canister.

With the advent of smaller automobiles and the more compact compartments for automobile engines the area for extending the handle on the aforementioned oil filter wrenches has been greatly reduced and in many instances the clearance necessary to extend the handle is no longer available. U.S. Pat. No. 4,552,040 is an example of an oil filter wrench with an extended handle.

Other devices, generally referred to as housing-type devices, do not require extending a handle; however, most of these devices are not adjustable and will fit only one size oil filter canister as exemplified by U.S. Pat. No. 4,266,452. There is disclosed four types of wrenches with adjustable mechanisms as found in U.S. Pat. Nos. 3,385,141; 4,964,330; 5,065,648; and 5,090,274. While the four aforementioned prior art devices are more than adequate for the purpose for which they were designed, they are deficient in the following manner.

As to U.S. Pat. No. 3,385,141 one embodiment requires that the oil filter canister be loosened prior to slipping the housing-type device over the oil filter canister. Utilizing this device requires two steps. The first step is to loosen the oil filter canister by one means or another and the second step consists of placing the housing-type device over the previously loosened oil filter canister for the final removal of the oil filter. A stated objective of the device is to protect the user from oil dripping over the top of the filter. It is obvious that the above embodiment is for protection from dripping oil not for the initial removal of the oil filter canister from the engine block. Another embodiment of the device has three independent toothed dogs pivotally mounted on pins with support brackets attached to the inside of the housing. This housing means is more than adequate to accept different size oil filter canisters.

However; this embodiment recognizes the difficulty in removing an oil filter canister by hand and; therefore, provides a hexagonal lug attached to the housing to aid in the removal of the oil filter canister by utilizing a hand wrench to be attached to the lug.

As to U.S. Pat. No. 4,964,330 the housing mechanism is designed to fit over various size oil filter canisters by employing several commonly recognized adjusting mechanisms to secure the housing means to the oil filter canister. The method for installing and removing an oil filter using the subject device consists mentioned housing mechanism. The difficulty in removing an oil filter by utilizing one's fingers is recognized in the application by stating that a small pry tool may be used to loosen a stuck or over tightened oil filter. In addition, should the automobile have recently been driven, the finger engagement means may also be extremely hot as the device is designated to remain attached to the oil filter canister during driving operations.

The device described in U.S. Pat. No. 5,065,648 is capable of grasping various size oil filter canisters; however, in order to apply leverage a wrench handle must be attached to the device. The handle protrudes outwardly from the grasping mechanism and; therefore, a relatively large amount of clearance is required to manipulate the oil filter wrench. The wrench appears to be most useful for a motor cycle engine as mentioned in the patent.

An oil filter changing device was granted U.S. Pat. No. 5,090,274. While the device is designated to fit various size oil filter canisters it also requires a handle be attached to the instrument to gain leverage in changing an oil filter canister. The mechanism for attaching the device to the oil filter canister protrudes outwardly from the oil filter canister. This condition; therefore, requires a considerable amount of space to accommodate the separate handle that must be affixed to the device for leverage.

From reviewing the prior art it is evident that there is lacking an oil filter canister tool suitable for extremely confined areas that provides sufficient means for grasping the tool by hand in a manner to maximize the leverage and torque associated with wrist action aided by arm strength and shoulder power for the removal and installation of an oil filter. Utilization of this procedure without the necessity of a separate handle is the stated object of the present invention. The small size and air cooled aspect of the device are additional benefits that maximize the usefulness of the device.

DISCLOSURE OF THE INVENTION

Briefly stated, the oil filter wrench that forms the basis of the present invention comprises in general: a relatively rigid strip of material, possibly metal, formed into the shape of an U with an adjustable circular metal band threaded perpendicularly through slot openings located near the ends of the arms of the U-shaped material. Said circular metal band having friction pads facing inwardly and located strategically around the inside circumference of the metal band to aid in securing the wrench to an oil filter canister. The U-shaped means is coated with a plastic or similar material to facilitate the gripping effectiveness of the device.

The invention is essentially the same size as an oil filter canister; and, therefore, the device is most appropriate and useful in the confined areas of present day automobile engine compartments. Additionally, the device remains attached to the oil filter canister and is always readily available for an oil filter change at any time or any place. This should prove most useful with military vehicles.

As will be explained in greater detail further on in the specification the U-shaped material is relatively flexible in that it will bend inwardly as the metal band is tightened and likewise will flex back to the original position as tension is released; therefore, the two units working in tandem provide an adjustable gripping mechanism.

By combining the flexible U-shaped material with the gripping metal band a small adjustable air cooled oil filter wrench is created with the property that the wrench may remain attached to the oil filter canister thus the tool is readily available for the next oil filter change.

BRIEF DESCRIPTION OF THE DRAWINGS

The above described characteristics and other attributes of the invention will become most clear upon a thorough study of the following descriptions of the best mode for carrying out the invention, particularly when reviewed in conjunction with the drawings wherein.

BEST MODE FOR CARRYING OUT THE INVENTION

Figure 1:
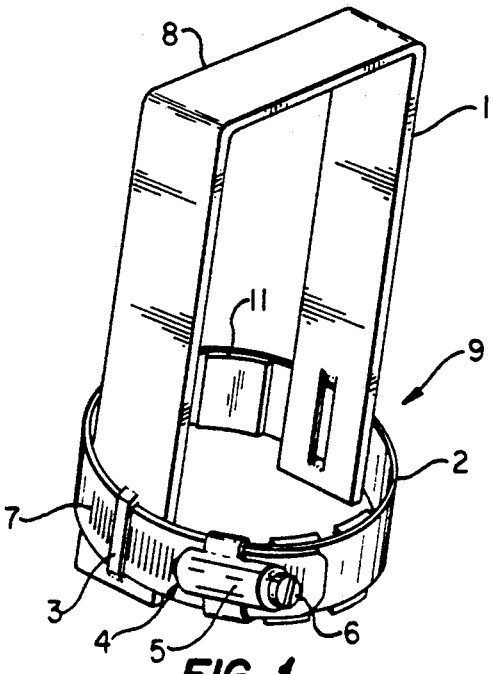
FIG. 1 is an isolated view of the apparatus.

As can be seen by reference to the drawings, and in particular to FIG. 1, the oil filter gripping device that forms the basis of the present invention is designated generally by the reference number (9). The apparatus (9) comprises in general: a coated U-shaped strip of material (1) with a metal band (2) having friction pads (11) attached thereto and said metal band (2) threaded perpendicularly through slot openings (3) located near the ends of the arms of the U-shaped means (1). These units will now be described in seriatim fashion.

Figure 2:
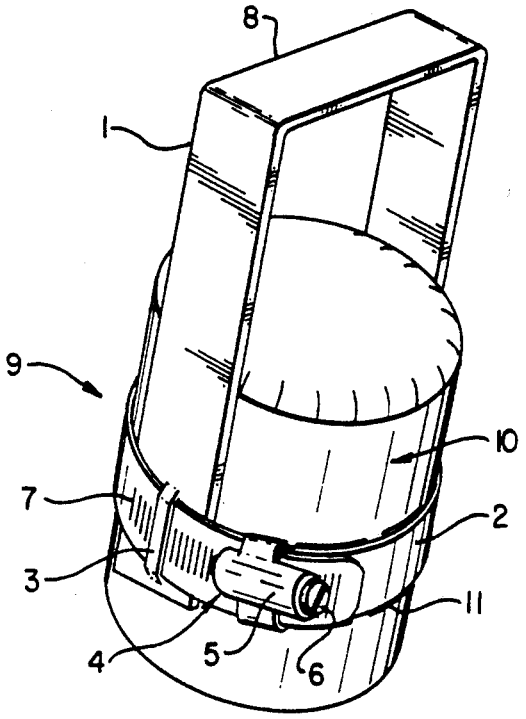
FIG. 2 is a view of the apparatus gripping an oil filter canister.

As shown in FIG. 1 and 2, the U-shaped means (1) has the metal band (2) held in position by threading the metal band (2) through the slot openings (3) located near the ends of the arms of the U-shaped means (1).

The metal band (2) has attached thereto a tightening, loosening and locking mechanism (4) for adjusting the metal band (2) to fit various size oil filter canisters (10). The preferred embodiment of the adjusting mechanism (4) consists of a screw housing means (5) attached to the metal band (2) with a screw (6) located therein allowing an individual to initiate the contraction or expansion of the metal band (2) by means of rotating the screw (6) wherein the screw (6) threads engage vertical slots (7) located uniformly along a portion of the metal band (2) thus enabling the metal band (2) to be adjusted to grip various size oil filter canisters (10). The U-shaped means (1) is flexible and will be drawn inwardly as the metal band (2) is contracted thereby gripping the oil filter canister (10) and likewise releasing the oil filter canister (10) as tension is removed. The U-shaped metal strip (1) is coated with a substance to provide friction between the gripping arms and the oil filter canister and also to provide a more suitable surface for physically grasping the device (9) by hand. The adjustable metal band (2) will have friction pads (11) attached strategically around the inside circumference of the band (2). These pads (11) are to be composed of heat resistant plastic or similar material and will aid in securing the device (9) to an oil filter canister (10) by means of friction.

Figure 3:
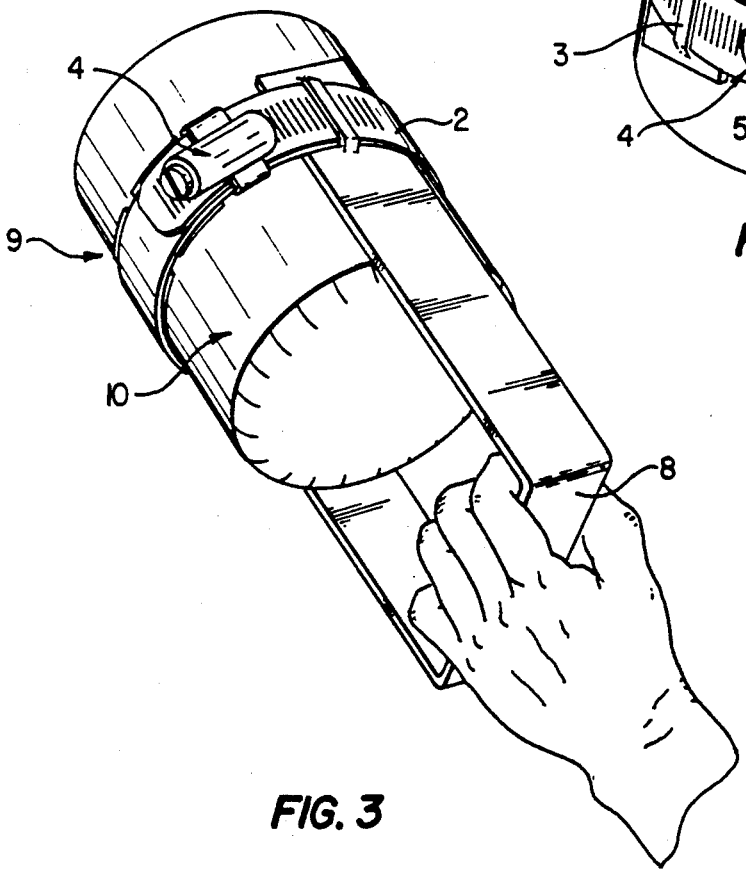
FIG. 3 is a view of the apparatus gripping an oil filter canister while held at the hand-grasping area.

Also, as can be seen in FIG. 3, the bottom portion of the U-shaped material (1) forms a hand-grasping area (8) that allows much force and leverage to be exerted by hand. The U-shaped device (9) enables the user to exert much force and torque by means of wrist action along with arm muscles and shoulder strength to loosen or tighten an oil filter canister without having to resort to the use of an additional tool or other device for assistance. The U-shaped means (1) conducts limited heat from the oil filter canister (10) in that very little of the surface area is in contact with the oil filter canister (10). Also during driving operations the device (9) dissipates heat quit rapidly as air rushes past a significant portion of the surface area of the U-shaped material (1) thereby providing a natural air cooling system.

In order to install an oil filter to an engine, the oil filter wrench (9) as shown in FIG. 3 is placed over a new oil filter canister (10) and is attached thereto by tightening the metal band (2) securely to the oil filter canister (10). Having secured the oil filter canister (10) to the oil filter wrench (9) a user grasps the oil filter wrench (9) at the hand-grasping area (8) and aligns the threads of the oil filter canister (10) with corresponding engine block threads and proceeds to rotate the oil filter canister (10) by means of wrist action until the oil filter canister is secured to the engine block. Additional torque can be gained, if necessary, to seal the oil filter canister (10) to the engine block by utilizing arm strength and shoulder power while further rotating the oil filter canister (10) by hand.

The oil filter wrench (9) remains attached to the oil filter canister during driving operations and thus to the engine as well. Therefore, in order to remove an oil filter from an engine all that is required is that an individual physically grasp the oil filter wrench (9) at the hand-grasping area (8) and proceed to remove the oil filter by rotating the oil filter canister (10) by means of wrist action. On extremely tight oil filter canisters (10) additional leverage can be gained by employing arm and shoulder strength to assist the wrist. No extraneous handle is required to operate the device.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. An apparatus for installing and removing an oil filter canister located on an automobile engine or similar engine comprising:

a handle having opposing arms that are relatively flexible and formed to fit over ends of various size oil filter canisters;

said handle having a hand-grasping area at a bottom portion of said handle;

a gripping band of flexible material attached to an upper portion of said arms of said handle and positioned perpendicularly thereto; and means attached to said gripping band for tightening and loosening said gripping band to urge said upper portions of said arms inwardly and outwardly, respectively, so that said apparatus may grip and release said canister.

2. The apparatus as in claim 1 further comprising at least one friction pad attached to an inner surface of said gripping band.

3. The apparatus as in 2 further comprising a coating having a high coefficient of friction, said coating being applied to inner surfaces of said upper portions of said arms.

* * * * *